US005671974A

United States Patent [19]

Boycott et al.

[11] Patent Number: 5,671,974

[45] Date of Patent: Sep. 30, 1997

[54] FURNITURE COUPLING SYSTEM AND METHOD

[76] Inventors: Brian Boycott; Edward Boycott, both of 11865 County Road No. 42, Tecumseh, Ontario, Canada, N8N 2M1

[21] Appl. No.: 510,443

[22] Filed: Aug. 2, 1995

[30] Foreign Application Priority Data

Aug. 11, 1994 [CA] Canada ..... 2129918

[51] Int. Cl.[6] ..... A47C 4/02

[52] U.S. Cl. ..... 297/440.2; 297/440.21; 403/393

[58] Field of Search ..... 297/440.15, 440.16, 297/440.2, 440.21; 403/393

[56] References Cited

U.S. PATENT DOCUMENTS

| | | | |
|---|---|---|---|
| 562,606 | 6/1896 | Henry | 297/440.2 X |
| 816,209 | 3/1906 | Beall | 297/440.2 X |
| 849,397 | 4/1907 | Hoffmann | 297/440.2 X |
| 2,146,520 | 2/1939 | Zimtbaum | 297/440.15 X |
| 2,660,271 | 11/1953 | Hupp | 403/393 X |
| 5,161,268 | 11/1992 | Harrow | 403/393 X |

FOREIGN PATENT DOCUMENTS

| | | | |
|---|---|---|---|
| 80854 | 9/1951 | Czechoslovakia | 297/440.2 |
| 3633035 | 4/1987 | Germany | 297/440.15 |

*Primary Examiner*—Peter R. Brown

*Attorney, Agent, or Firm*—Sterne, Kessler, Goldstein & Fox P.L.L.C.

[57] ABSTRACT

A coupling mechanism and method which allows for removably securing a chair or sofa back to a chair or sofa base. The coupling mechanism comprises a mounting bracket which attaches to the base of a piece of seating furniture and an engaging back bracket which attaches to the back of seating furniture. The back bracket has a pair of pins which are cooperable with a pair of slots located on the mounting bracket.

11 Claims, 2 Drawing Sheets

FURNITURE COUPLING SYSTEM AND METHOD

The present invention relates generally to furniture and particularly to chairs or sofas having a base and a back, and wherein the back is removable from the base.

BACKGROUND OF THE INVENTION

Typically today's chairs or sofas are manufactured with a seat mounted on a base which is attached to a back. For shipping and storing purposes it therefore results that the area forward of the back and above the seat is wasted. It follows that in order to effect compact shipping configuration and to maximize the number of products that can be shipped and stored per unit volume, a better packing method must be made available. More particularly, detachable seat backs have been developed and have primarily been used on reclining-type chairs.

One solution to the problem of providing a reliable detachable seat back for a chair is disclosed in U.S. Pat. No. 3,525,549 to Knabusch et al which shows a chair back equipped with a slide bracket on each side edge. The slide bracket itself is composed of a web having inwardly presenting channel sections at the sides and top. Apertures in the web receive securing elements by which the brackets are secured to the back. Locking arms secure the brackets and links against separation and retain them in firm fixed relation against any movement when in use. By releasing the locking arms the back and seat can be separated. While this substantially reduces the volume occupied by the chair, the camming action makes it often difficult to separate the slide bracket from the mounting bracket and can become noisy when the seat occupant applies pressure to the seat back.

Another solution is disclosed in U.S. Pat. No. 4,148,106 to Gallien where a coupling permitting rapid assembly of furniture frame members is provided. Each coupling of the system includes a hook member formed of a metal plate and having a pair of hooks that can hook into corresponding rods located in another frame member. While this provides for the taking apart of primarily wooden framed members, it is hardly applicable to sofa or chair backs due to its structure and design restrictions.

Yet another solution is disclosed in Canadian Patent Application No. 2,056,280 to the La-Z-Boy Chair Company where linkages supported from the chair frame are provided for receiving slide brackets secured to opposite sides of the seat back thereon for supporting the seat back on the chair frame. Relative movement between the slide brackets and the upstanding links is prevented by the mating engagement of the arcuate cam surfaces. While this mechanism provides for an easily detachable chair back, it is more particularly applicable to reclining-type chairs which typically have high seat back members.

There is therefore a need for a simple and rapid furniture assembly system and method which avoids the above disadvantages.

SUMMARY OF THE INVENTION

An object of the present invention is to provide an improved furniture coupling system for the rapid assembly of seating furniture.

In accordance with one aspect of the present invention there is provided a furniture coupling system comprising a pair of cooperatively engaging brackets on each side of an item of seating furniture for removably connecting a back to a base, each of said pair of brackets comprising a tapped two-slotted mounting bracket and a two-pin engaging bracket; and a retainer aperture for further securing the back onto the base once the brackets are engaged.

The present invention therefore provides a furniture coupling system in which mounting brackets are attached to the base of a piece of seating furniture and where reciprocally engaging back brackets are attached to the back of seating furniture. The mounting brackets present two (2) opening slots for easy insertion of the cooperable pins which are part of the back brackets. The shape of the mounting brackets and its associated slots makes for easy and rapid attachment of the seat back. One advantage of the present invention is that a chair or sofa back may be easily secured to a base, and just as easily removed from it.

There is further provided a method for assembling an item of seating furniture including a back and a base adapted to support said back, said base including a mounting bracket attached on each side adapted for engagement with an engaging bracket attached to each side of said back, said method comprising: attaching the two tapped pins to the engaging bracket; sliding the two tapped pins of the engaging bracket into the cooperable two slots of the mounting bracket; securing the two tapped pins against the mounting bracket; and further securing of the back onto the base.

Another advantage of the present invention is that there are no moving parts involved but rather a simple sliding of pins into apertures.

Yet another advantage of the present invention is that a chair or sofa comprising a seat, base and back may be compacted for more efficient shipping thereof.

Further objects and advantages of the present invention will be apparent from the following description, reference being made to the accompanying drawings wherein preferred embodiments of the present invention are clearly shown.

DESCRIPTION OF THE PREFERRED EMBODIMENTS

Figure 1:
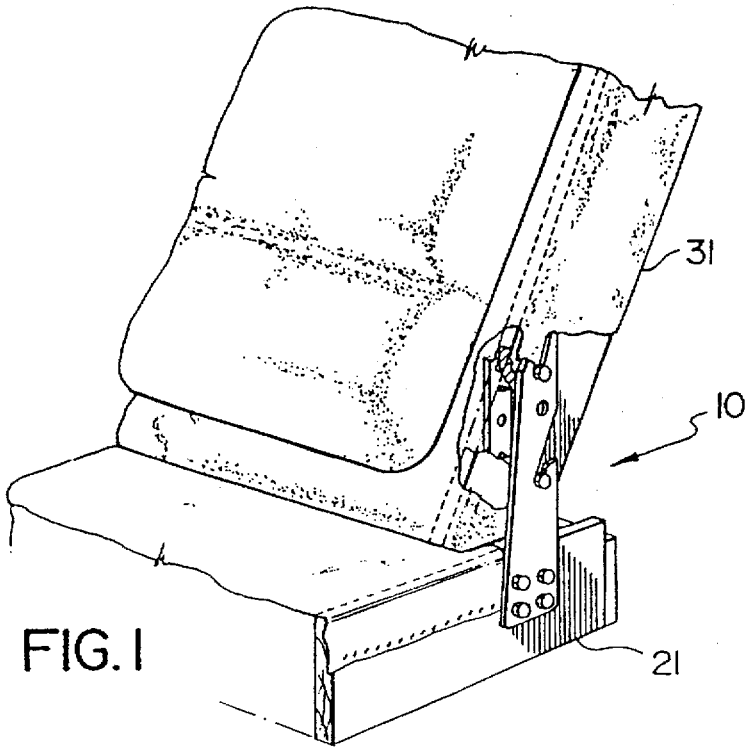
FIG. 1 is a perspective view of a chair embodying the invention.

FIG. 1 illustrates an assembled seating furniture 10 which utilizes the coupling system and method of the present invention to connect the base 21 and the back 31 of the seating furniture to form a chair or sofa.

Figure 2:
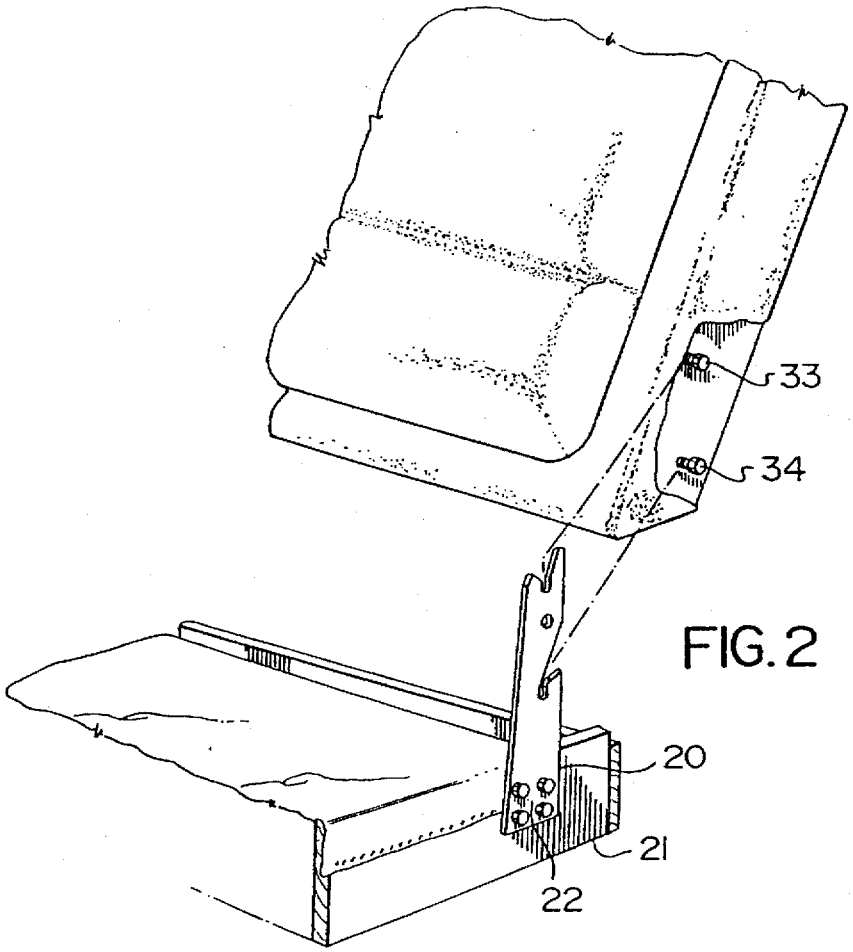
FIG. 2 is a perspective view of a chair base with a mounting bracket.
Figure 3:
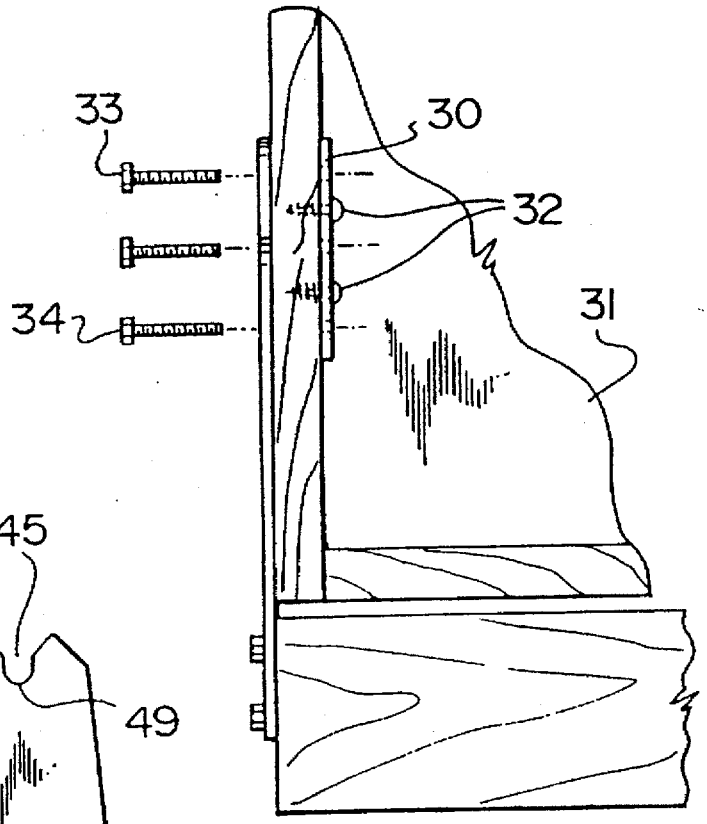
FIG. 3 is a perspective view of a chair back with an engaging bracket.

As shown in FIG. 2 and 3 the coupling system includes a mounting bracket 20 which is attached to the base 21 of the seating furniture through apertures 22 located at its lower end and an engaging bracket 30 which is attached to the inside section of the back frame 31 through apertures located in its mid-section 32.

Figure 4:
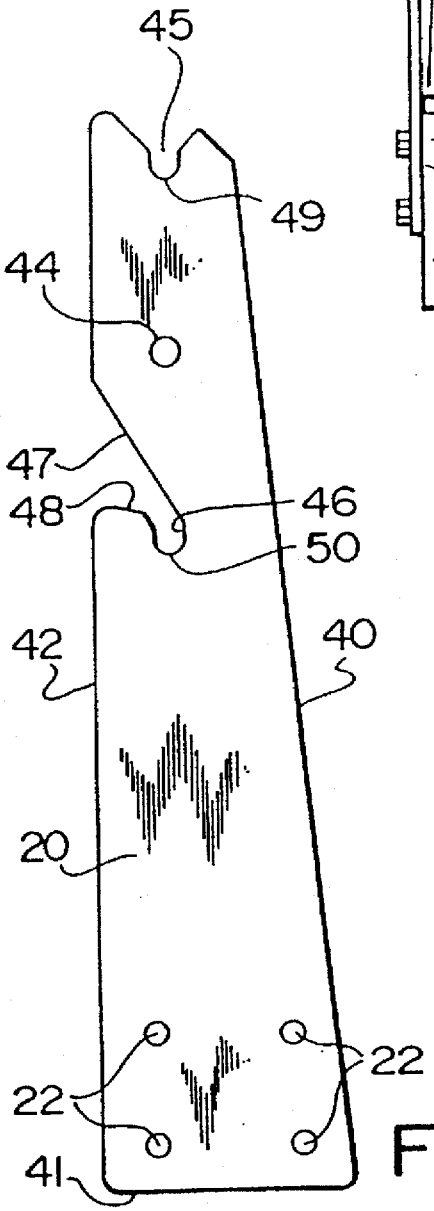
FIG. 4 enlarged view of a mounting bracket.

FIG. 4 illustrates a mounting bracket 20 which is slanted at approximately 6.5° on its non-slotted side 40 and planar at the base 41 and the slotted side 42. As shown there are provided four (4) apertures 22 at its lower end for attachment of the mounting bracket 20 to the base 21 of the seating furniture. Another aperture 44 is provided for securing the mounting bracket 20 to the back 31 of the seating furniture once the engaging bracket 30 is in place. It can be seen that the top slot area 45 which receives the upper pin 33 of the engaging bracket is cut at an angle of approximately 45° in order to facilitate the insertion of that upper pin 33 and consequently of the lower pin 34 into the lower slot 46. The lower slot 46 is provided with a fairly wide mouth angled at approximately 33° on its upper longer side 47 and at approximately 10° on its shorter side 48 to make for an easy insertion of the engaging pin 55 or 56 and the back 31 of the seating furniture. The slot centers or locking points 49, 50 which represent the pins 33 and 34 resting points are downwardly oriented and aligned in order to provide for secure, non-shifting attachment of a back member to the seat, as will be described.

Figure 5:
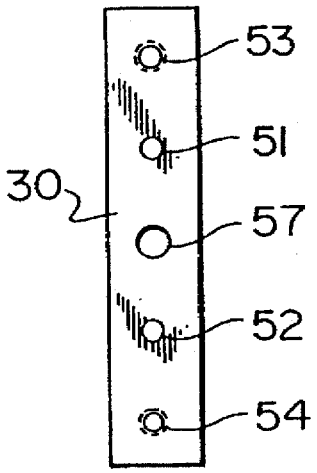
FIG. 5 is an enlarged view of an engaging bracket.

FIG. 5 illustrates an engaging bracket 30 which is rectangular in shape with two (2) apertures 51 and 52 for attaching the bracket to the inside portion of the back 31 of the seating furniture, two (2) more apertures, these ones being tapped, 53 and 54 for the pins 33 and 34 showing through the frame of the back of the seating furniture used for the actual mounting of the seating furniture and finally a central aperture 57 for securing the back 31 and base 21 of the seating furniture once in place. Apertures 53, 54 and 57 are cooperatively positioned so as to correspond to slots 45 and 46, and aperture 44 of the mounting bracket 20 for easy insertion and securing.

The back 31 of the seating furniture is installed onto the base 21 by moving the engaging bracket's 30 pins 33 and 34 downwardly and into the slots 45 and 46 of the mounting bracket 20 until the pins 33 and 34 hook into the slot openings 45 and 46 to complete the installation. Once the pins 33 and 34 are inserted into the slots 45 and 46, it is often desirable, although not necessary, that the seating furniture be fastened permanently together to the extent that the seating furniture will not become disassembled when it is lifted for instance. By simply tightening the tapped screw-pins' 33 and 34 a more permanent fit is achieved. For even further securing, aperture 57 is used in combination with aperture 44 of the mounting bracket 20 for attaching the back 31 to the base 21 of the seating furniture before the final upholstering of the seating furniture is completed.

While the form of the apparatus herein described constitutes a preferred embodiment of the invention, it is to be understood that the invention is not limited to this precise form, so that changes may be made therein without departing from the scope of the invention.

The embodiments of the invention in which an exclusive property or privilege is claimed are defined as follows:

1. A coupling for connecting members of seating furniture comprising:

a mounting bracket attached to a base of said furniture, said mounting bracket including a pair of slots;

an engaging bracket attached to a back of said furniture;

a pair of pins disposed in said engaging bracket wherein each of said pins is removably engageable in one of said pair of slots of said mounting bracket for removably connecting said back to said base;

a first retaining aperture defined in said mounting bracket;

a second retaining aperture defined in said engaging bracket;

wherein a fastener is removably receivable within said first retaining aperture and said second retaining aperture for removably securing said back to said base after said mounting bracket and said engaging bracket are engaged; and wherein one of said pair of slots has a locking point disposed at a center of said slot for receiving one of said pair of pins and wherein an opening of said one of said pair of slots is defined by a first angled inwardly extending surface and second angled inwardly extending surfaced opposed to said first surface, wherein said first angled inwardly extendingsurface is angled at approximately 45° from said opening to said locking point.

2. A coupling for connecting members of seating furniture as set forth in claim 1, wherein said mounting bracket further comprises:

connection means for connecting said mounting bracket to said base; and wherein said pair of slots are located in an upper third section of said mounting bracket for receiving said pins.

3. A coupling for connecting members of seating furniture as set forth in claim 2, wherein one side of said mounting bracket is angled at approximately 6.5° with respect to another side of said bracket.

4. A coupling for connecting members of seating furniture as set forth in claim 1, wherein another of said pair of slots has a locking point disposed at a center of said slot for receiving the other of said pair of pins; and wherein an opening of said other of said pair of slots is defined a first angled inwardly extending surface and a second angled inwardly extending surface wherein said first angled inwardly extending surface is angled at approximately 33° from said opening said locking point and said second angled inwardly extending surface is angled at approximately 10° from said opening to said locking point.

5. A coupling for connecting members of seating furniture as set forth in claim 4, wherein said locking point is defined by two opposing vertical surfaces and is disposed generally in the center of said mounting bracket.

6. A coupling for connecting members of seating furniture as set forth in claim 4, wherein said engaging bracket further comprises:

first aperture means formed in said engaging bracket for connecting said engaging bracket to said back; and second aperture means formed in aid engaging bracket for receiving said pair of pins.

7. A coupling for connecting members of seating furniture as set forth in claim 6, wherein said second aperture means are separated by a distance equal to the distance between said locking points on said mounting bracket.

8. A method for assembling an item of seating furniture including a back and a base adapted to support said back, said base including a mounting bracket attached on each side of said base for engagement with an engaging bracket attached to each side of said back, said method comprising:

attaching a pair of pins to said engaging bracket;

sliding said pair of pins into cooperable slots formed in said mounting bracket;

tightening said pair of pins against said mounting bracket; and providing means in said mounting bracket and in said engaging bracket for further securing said back to said base.

9. A coupling for connecting members of seating furniture comprising:

a mounting bracket attached to a base of said furniture, said mounting bracket including a slot, said slot including a locking point disposed at a center of said slot wherein an opening of said slot is defined by a first angled inwardly extending surface and a second angled inwardly extending surface, wherein said first angled inwardly extending surface is angled at approximately 33° from said opening to said locking point and said second angled inwardly extending surface is angled at approximately 10° from said opening to said locking point;

an engaging bracket attached to a back of said furniture; and a pin disposed in said engaging bracket wherein said pin is removably engageable in said slot of said mounting bracket for removably connecting said back to said base.

10. A coupling for connecting members of seating furniture as set forth in claim 9, wherein said locking point is define by two opposing vertical surfaces and is disposed generally in the center of said mounting bracket.

11. A coupling for connecting members of seating furniture as set forth in claim 9, wherein said engaging bracket further comprises:

first aperture means formed in said engaging bracket for connecting said engaging bracket to said back; and second aperture means formed in said engaging bracket for receiving said pair of pins.

* * * * *